US006068050A

United States Patent [19]

Ghiani

[11] Patent Number: 6,068,050

[45] Date of Patent: May 30, 2000

[54] HEAT TRANSFER DEVICE FOR A MOTOR VEHICLE AND PROCESS OF MAKING SAME

[75] Inventor: Franco Ghiani, Bietigheim-Bissingen, Germany

[73] Assignee: Behr GmbH & Co., Stuttgart, Germany

[21] Appl. No.: 09/038,108

[22] Filed: Mar. 11, 1998

[30] Foreign Application Priority Data

Mar. 11, 1997 [DE] Germany ..... 197 09 909
May 27, 1997 [DE] Germany ..... 197 22 099

[51] Int. Cl.[7] ..... F28F 9/22; F28F 9/04

[52] U.S. Cl. ..... 165/174; 165/DIG. 482; 165/DIG. 471

[58] Field of Search ..... 165/148, 174, 165/176, DIG. 482

[56] References Cited

U.S. PATENT DOCUMENTS

| | | | |
|---|---|---|---|
| 2,182,338 | 12/1939 | Gurlik | 165/DIG. 482 |
| 3,016,230 | 1/1962 | Cederstrom et al. | 165/148 |
| 5,097,900 | 3/1992 | Yamaguchi . | |
| 5,209,292 | 5/1993 | Arneson et al. | 165/176 |

FOREIGN PATENT DOCUMENTS

| | | |
|---|---|---|
| 0 480 628 | 4/1992 | European Pat. Off. . |
| 0 709 644 | 5/1996 | European Pat. Off. . |
| 2 148 482 | 3/1973 | France . |
| 2 603 373 | 3/1988 | France . |
| 3834822 | 4/1990 | Germany . |
| 378353 | 7/1964 | Switzerland . |
| 195 43 986 | 5/1997 | United Kingdom . |

*Primary Examiner*—Allen Flanigan
*Assistant Examiner*—Kimberly Cooper
*Attorney, Agent, or Firm*—Evenson, McKeown, Edwards & Lenahan, P.L.L.C.

[57] ABSTRACT

A heat transfer device for a motor vehicle includes a rib/tube block arranged between two collection containers. The tube ends of the fin/tube block are widened in the area of each collection container and are then brought together flat into end packets. Both collection containers are set flush to a respective tube end packet and brazed hermetically to the same. At least one collection container is provided with at least one partition wall that divides the collection container. The partition wall has an outer contour that corresponds to the inner contour of the wall of the collection container. As a result, the partition wall can be soldered hermetically around the inner contour. A holding leg is provided on the partition wall and is inserted over two adjacent wall sections of neighboring tube ends of the tube end packet. One use of the device is as a water/air radiator.

19 Claims, 2 Drawing Sheets

HEAT TRANSFER DEVICE FOR A MOTOR VEHICLE AND PROCESS OF MAKING SAME

BACKGROUND AND SUMMARY OF THE INVENTION

This application claims the priority of German application Nos. 197 09 909.2 and 197 22 099.1, filed on Mar. 11, 1997 and May 27, 1997, respectively, the disclosures of which are expressly incorporated by reference herein.

This invention concerns a heat transfer device for a motor vehicle with a rib/tube fin/tube block arranged between two collection containers. The tube ends of the fin/tube block are all widened in areas of the collection containers and are brought together into a tube end packet. Both collection containers are set flush to the respective tube end packet and brazed hermetically to the same.

A heat transfer device of this type is described in unpublished German application DE 19,543,986.4. In heat transfer devices of this kind, a fin/tube block including flat tubes and corrugated ribs is provided. The tube ends of the flat tubes are widened to produce square sections so that the neighboring tube ends lie flat against each other in a row with the wall sections representing their wide sides. The wall sections representing the narrow sides of the widened tube ends are arranged at each side in a mutual straight line. The tube ends form a compact and closely-lying tube end packet at each of the opposing sides of the flat tubes. A collection container is arranged at each tube end packet and grips onto the narrow area formed by the narrow sides of the tube ends from outside. The container lies flush against the tube ends as a result of the narrow area formed by the narrow sides. The collection containers grip directly over the widened tube ends in the longitudinal direction and produce a hermetic connection due to the flush position in the longitudinal direction. Consequently, the heat transfer device requires no additional bottom in the area of the collection containers. Both the collection containers and the fin/tube block are made out of metal plates that can be connected to each other by mutual brazing.

A primary object of the invention is to provide a heat transfer device of the kind described above which facilitates an improved guidance of the circulation medium through the collection containers and the flat tubes of the fin/tube block.

This primary object is attained by providing a particular construction including at least one partition wall in at least one of the collection containers which has an outer contour corresponding to that of the inner contour of the wall of the collection container so that the outer contour can be brazed hermetically around this inner contour, and in which the tube ends of the tube end packet have two neighboring flush interlocking wall sections for insertion into a gap defined by a holding leg provided on the partition wall. By providing at least one partition wall in one of the two collection containers, it is possible to deviate the circulation medium within the fin/tube block so that the medium flows in a path taking the shape of a "U". The connections for the input and output of the circulation medium can be provided, if necessary, on one of the collection containers. The collection containers have collection or distribution functions, depending upon their connections to the corresponding circulation medium flow. Coolant, water, or air, in particular, can be utilized as the circulation medium. The heat transfer device can be any of a coolant/air, water/air, or air/air radiator. The air/air radiator is a load air radiator. In heat transfer devices with tube bottoms, it is already known to have partition walls. According to the invention, at least one partition wall can be provided in collection containers where an additional tube bottom is not provided. The containers are positioned directly on the widened tube ends of the fin/tube block. The partition wall is structured in such a way that it can be integrated during premounting of the complete heat transfer. The partition wall can then be connected hermetically to the collection container and the corresponding tube ends together with the remaining parts of the heat transfer device in a brazing oven by a mutual brazing process. Because of the provision of the holding leg, the partition wall can be installed in a simple manner before mounting the collection container onto the corresponding wall sections of the corresponding tube ends.

According to one feature of preferred embodiments of the invention, the holding leg has at least one one-piece bridge-like latch which protrudes from the partition wall and forms a receiving slit. The receiving slit is structured in such a manner that the partition wall can be set in different positions along the wall sections before the brazing step and, in any event, can even be pushed along the wall sections of the tube ends for adjustment.

According to another feature of preferred embodiments of the invention, the holding leg is provided with centering protrusions for inserting into the wall sections of the tube ends. Insertion of the partition wall into the wall sections of the corresponding tube ends is simplified by these centering protrusions. The partition wall is held force-fittingly on the corresponding tube ends by the holding leg.

According to a further feature of preferred embodiments of the invention, the partition wall has a distance to the holding leg for at least one fixing nose, which reaches into a corresponding gap in the wall of the collection container in the assembled condition of the partition wall. In this way, an additional form-fitting fixing of the partition wall onto the collection container is obtained, so that an extraordinarily stable partition of the collection container is achieved. It is therefore possible to allow high pressure fluid circulation within the heat transfer device before the partition wall is held form-fittingly to the wall sections of the corresponding tube ends. The fixing nose, similar to the latch, is also made as a single piece with the holding leg, so that the partition wall can be structured as a very simple stamped plate piece.

According to a further feature of preferred embodiments of the invention, the fixing nose is provided with at least one deformable protruding corner, which reaches through the gap in the wall of the collection container in the mounted or assembled condition of the partition wall, and which is deformed in such a way that it grips form-fittingly onto the back of an edge of the gap at the outer side of the collection container. It is possible in this way to improve the form-fit between the partition wall and the collection container before brazing the complete heat transfer unit. The protruding corners are bent in a simple manner so that a firm grip on the outer side of the collection container is achieved. The protruding corners are advantageously arranged on the opposite sides of the fixing nose and lie opposite each other. The protruding corners are deformed in the same (clockwise) direction. In this way, a secure grip between the partition wall and the collection container results before soldering. The partition wall, in the premounted condition of the heat transfer unit, i.e., before carrying out the soldering process, is already securely and clearly positioned as a result.

According to yet a further feature of preferred embodiments of the invention, the collection container has at least one positioning rib in the area of the partition wall that extends along a plane parallel to the partition wall, onto which the partition wall leans flat in the assembled position. The stable positioning of the partition wall is further improved by this form-fitting arrangement.

According to yet another feature of preferred embodiments of the invention, two parallel, evenly distanced positioning ribs are provided at the collection container, and the partition wall is provided with support edges that correspond in size to the distance of the positioning ribs so that the partition wall is held axially secure between the positioning ribs with respect to a longitudinal axis of the collection container. In this way, the positioning ribs form oblique guides and arrangements for the partition wall, so that a defined installation of the partition wall within the collection container is obtained. The partition wall is preferably premounted before it is installed at the corresponding tube end packet. With the additional installation of the collection container, the partition wall is inserted at the corresponding wall sections of two neighboring tube ends by use of its holding leg.

BRIEF DESCRIPTION OF THE DRAWINGS

Further advantages and features of the invention will become apparent from the following description of the preferred embodiment of the invention, which is shown in the drawings.

DESCRIPTION OF THE PREFERRED EMBODIMENT

Figure 1:
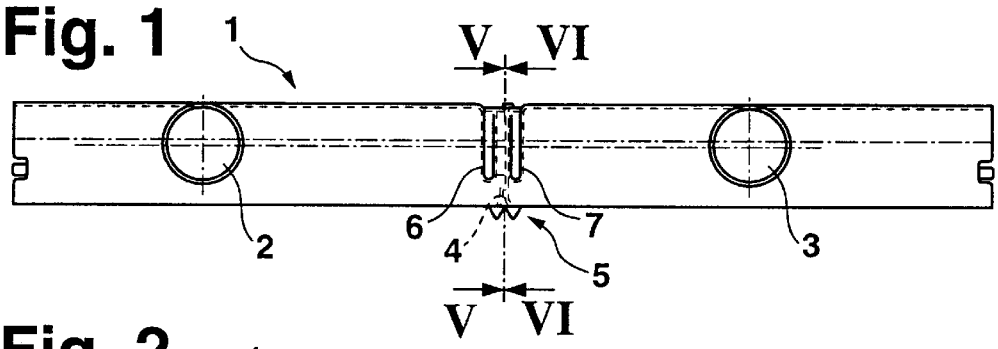
FIG. 1 is a view of a collection container according to a preferred embodiment of the heat transfer device of the invention.

A heat transfer device of the type represented in FIGS. 1 to 4 may be structured as a water/air radiator and has an essential construction similar to the heat transfer device described in German application DE 19,543,986.4. The water/air radiator includes a fin/tube block F, W. The block F, W. includes a plurality of flat tubes F running parallel to each other, as well as of a plurality of corrugated ribs W arranged between the tubes. Each of the flat tubes F has tube ends 5 at its opposite ends. These ends are widened in such a manner that each neighboring tube end 5 lies flat along a mutual straight line. Each tube end 5 is widened into a square section. Neighboring tube ends 5 are connected to each other at their widened sides. The tube ends 5 are connected flat against each other on a mutual straight line. The tube ends 5 are aligned with their widened "small sides" in one common line or plane. A water container 1 that serves as a collection container is installed on the tube ends 5 on the opposite sides of the fin/tube block F, W. The water containers 1 are structured as U-shaped profiles. Each water container faces the fin/tube block F, W and opens to the front. The water containers on the opposite sides of the fin/tube block F, W have essentially the same profile. These water containers are differentiated only in that one of the water containers 1, as shown in FIGS. 1 to 5, has two connecting branches or sleeves 2, 3. One connecting branch 2 defines an inlet for the water cooled by the fin/tube block F, W. The other connecting branch 3 defines an outlet. The connections, however, can also be reversed. The connections at the radiator circulation are therefore provided essentially at the water container 1. Each water container is installed on the widened tube ends 5 in such a manner that the side walls of each water container grip over the opposite sides of the tube ends and are connected flush as well as flat against the same. In the area of the opposite front side, both water containers are closed off by appendices of corresponding side pieces, which delimit the fin/tube block F, W on the sides and hermetically close off the profiles of the water containers on the front side. The water containers, as well as the side parts, the flat tubes F and the corrugated ribs W, are made of metal, preferably aluminum, and are brazed hermetically together in a mutual brazing operation.

Midway of the axial length, in the longitudinal direction of the water container 1, is provided a partition wall 4. The partition wall divides the water container 1 into two halves for facilitating a U-shaped throughflow of the water to be cooled as it passes through the water/air radiator. The flow proceeds from the entry connecting branch 2, through a first half of the fin/tube block, into the opposite water container, through the other half of the fin/tube block back to the water container 1, and to the connecting branch serving as an exit support. The partition wall 4 forms a hermetic closure together with the water container 1 and the corresponding tube ends 5. A secure separation is obtained between both the circulation space and the first half of the water container 1 and the circulation space and the second half of the water container 1.

The partition wall 4 represents an essentially flat metal plate, which is also preferably made of aluminum. The shape and dimensions of the outer contour of the partition wall 4 are adapted to the shape and dimensions of an inner contour of the U-shaped profile (FIG. 5) of the water container 1. The partition wall 4 therefore lies, when it is installed in the water container 1, so that its outer contour surrounds the inner contour of the inner wall of the water container 1. The outer contour of the partition wall 4 can be seen in FIG. 6. It must be taken into consideration that the partition wall 4 is rotated with respect to the represented profile of the water container 1 according to FIG. 5.

Figure 2:
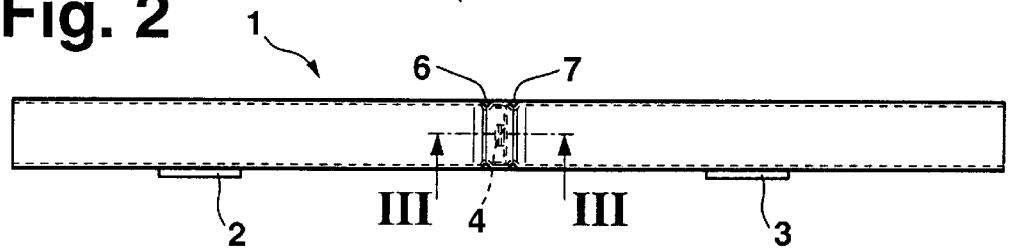
FIG. 2 is a plan view of the collection container shown in FIG. 1.
Figure 3:
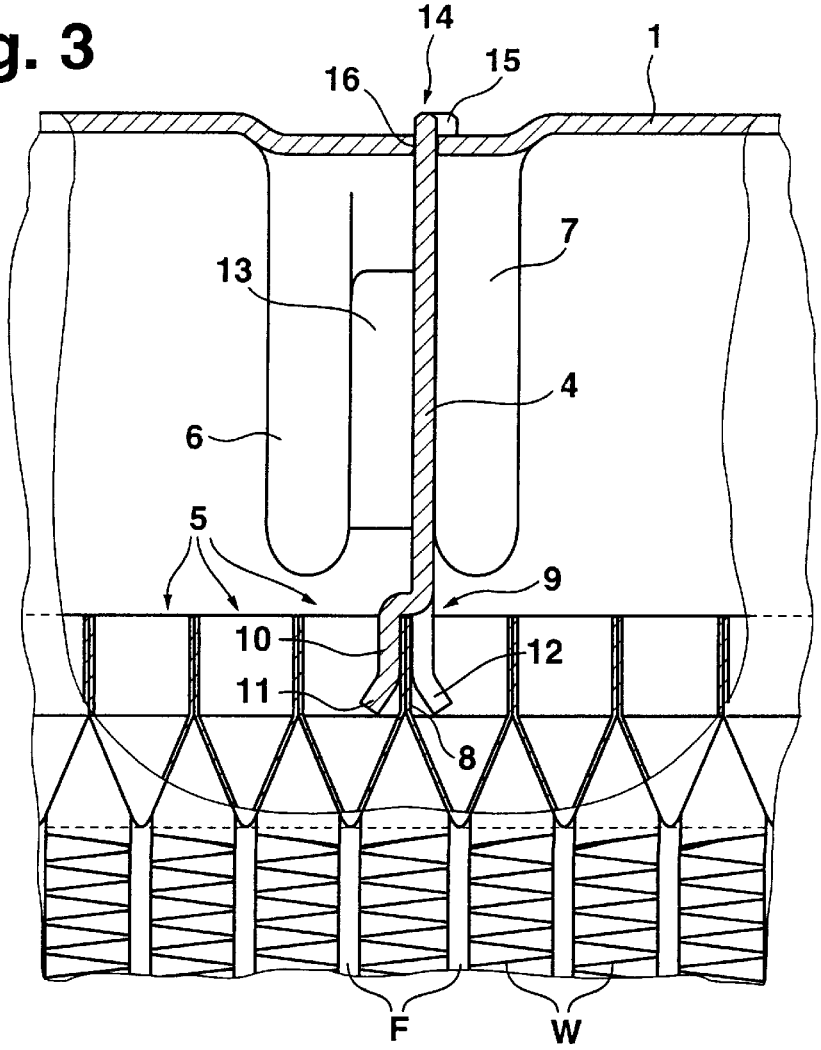
FIG. 3 is an enlarged representation of a section of the heat transfer device in the area of the collection container according to FIGS. 1 and 2 at the location of a partition wall within the collection container.
Figure 6:
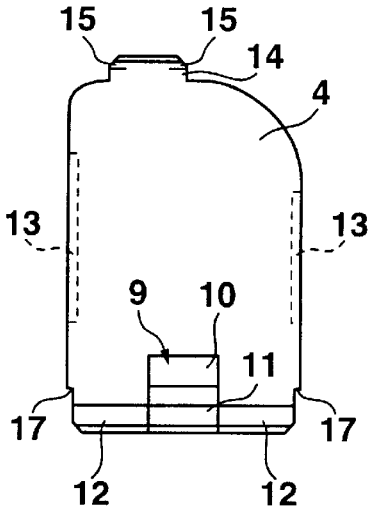
FIG. 6 is a view of a partition wall as seen along section line VI—VI of FIG. 1.

The partition wall 4 has a holding leg 9 which reaches through the open front side of two neighboring tube ends 5. These two tube ends are located halfway of the width of the fin/tube block as shown in FIGS. 1 to 3. In this way, the facing side edges defining the outer contour of the partition wall 4 are provided in the leg area of the partition wall 4, at the level of the holding leg 9, with recesses or indentations 17 (FIG. 6). The recesses or indentations 17 in the side edges are supported by the upper front edges of the corresponding tube ends 5 in the inserted condition of the partition wall 4. The distance between the recesses or indentations 17 corresponds exactly to the inner measurements of the openings of the flat tubes F defined by the tube ends 5.

Figure 7:
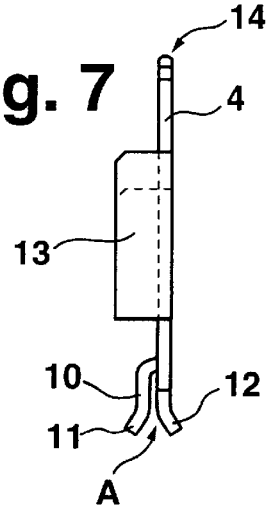
FIG. 7 is a side view of the partition wall shown in FIG. 6.
Figure 8:
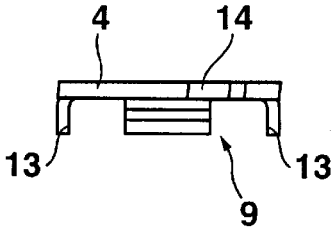
FIG. 8 is a plan view of the partition wall shown in FIGS. 6 and 7.

The holding leg 9 also has a single-piece adapted and stepped bent support latch 10, 11. This latch protrudes from the partition wall 4 so that a receiving slit A, which opens to opposite sides, results between the support latch 10 and the plane defined by the plate shape of the partition wall 4 This facilitates a firm connection of the partition wall 4 to the closely-lying wide-sided wall sections of the neighboring tube ends 5 as shown in FIG. 7. The lower front ends of the holding leg 9 have centering traversals or flanges 11, 12, bent transversely to the outside in the area of the support latches 10 and in the plate area of the partition wall 4. This permits a safe insertion of the partition wall 4 into the corresponding wall sections 8 of the neighboring tube ends 5 even with reduced axial displacement in the longitudinal direction of the water container 1.

In addition to the resulting hermetic brazing with the inner wall of the water container 1 in its area of the linear-shaped arrangement of its outer contour, the partition 4 is positioned form-fittingly on the water container 1. For this reason, two positioning ribs 6, 7 are provided. These ribs extend in U-shapes over the inner wall of the water container (FIG. 5) and protrude from the inside of the inner wall. Both of the positioning ribs 6, 7 are shaped as bulges. Both of the positioning ribs 6, 7 run along parallel radial planes with respect to a longitudinal axis of the water container 1 which runs along the longitudinal direction of the water container 1. The partition wall 4 is held in axial position between these positioning ribs 6, 7 by two support edges 13. The support edges protrude narrowly at a right angle from the opposite side edges of the outer contour of the partition wall 4 together with this outer contour. The support edges, moreover, are adapted to each other in such a manner and, according to the distance between both positioning ribs 6, 7, that they are held exactly between the positioning ribs 6, 7. The support edges 13, and therefore the partition wall 4, can be displaced by pushing them in the radial plane of the water container 1, and therefore in the plane of the partition wall 4, between the positioning ribs 6, 7, which at this point form nothing more than linear guides.

Figure 4:
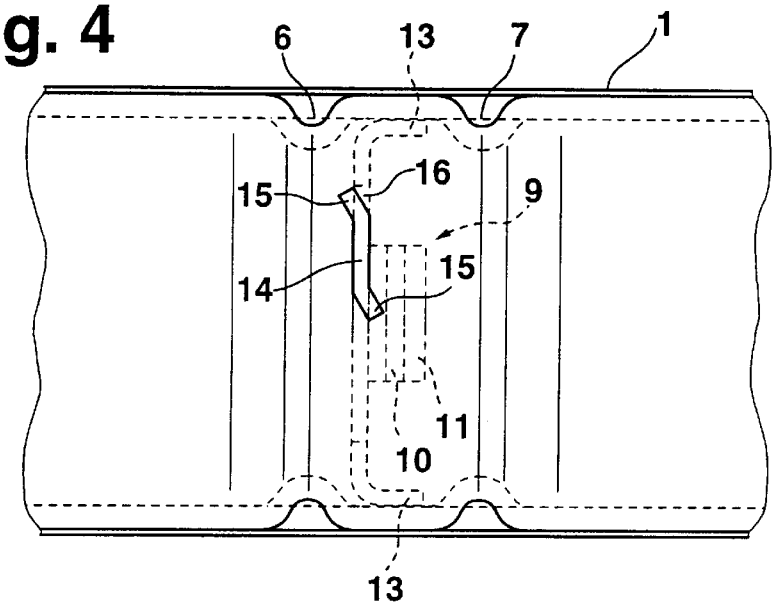
FIG. 4 is an enlarged representation of a plan view of the part of the heat transfer device shown in FIG. 3 as seen in the direction of arrow IV.
Figure 5:
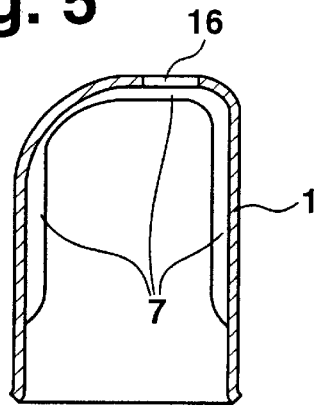
FIG. 5 is a view of the collection container of the heat transfer device shown in FIGS. 1 to 4 at the location of the partition wall, but without representing the partition wall, along section line V—V of FIG. 1.

A head piece of the partition wall 4 lying opposite to the holding leg 9, which extends upward into the plane of the partition wall 4, is provided with a fixing nose 14 for additionally fixing the partition wall 4 in position when inserted into the water container 1. This fixing nose 14 corresponds to a slit-shaped gap 16 in the water container 1, through which the fixing nose 14 reaches into the outer side of the water container 1. The fixing nose 14 is also provided with bent edges or corners 15 on its opposite sides. These bent edges or corners are formed in a simple manner by corresponding slits in the fixing nose 14 which are parallel to the outer side of the water container 1 at opposite sides. These edges or corners 15 are deformable, and the slits are preferably adapted to the depth of the gap 16 in the water container 1 in such a way that the corners 15 at the outer side of the water container 1 can be bent to the side and build a grip for the partition wall 4 together with the water container 1 (FIG. 4). With respect to FIG. 4, it must be taken into consideration that the represented plan view is shown rotated by 180° with respect to the representation according to FIGS. 1 to 3.

For mounting the water/air radiator, and particularly for mounting the partition wall 4 within the water container 1, the partition wall 4 is first inserted sufficiently far that the fixing nose 14 protrudes through the gap 16. In this way, the partition wall 4 can be pushed between both positioning ribs 6, 7 until its outer contour is aligned with the inner wall of the water container 1. The corners 15 are then preferably bent by a tool such as pliers or the like according to FIG. 4. In this way, a form-fitting fixing of the partition wall 4 in the water container 1 results. The holding leg 9 is necessarily inserted into the wall sections 8 of the corresponding neighboring tube ends 5 during the positioning of the water container 1 onto the widened tube ends 5 of the fin/tube block F, W, until the ends of the recesses or indentations 17 hit the upper front edges of each tube end. After installing the side parts, the premounted water/air radiator can be brazed hermetically in a simple manner in a brazing oven during a single brazing process.

Of course, all the hermetically brazed parts of the water/air radiator, and therefore also the corresponding surfaces of the partition wall 4 and the water container 1, have suitable brazed plating, which effects this soldering.

The foregoing disclosure has been set forth merely to illustrate the invention and is not intended to be limiting. Since modifications of the disclosed embodiment incorporating the spirit and substance of the invention may occur to persons skilled in the art, the invention should be construed to include everything within the scope of the appended claims and equivalents thereof.

I claim:

1. A heat transfer device for a motor vehicle comprising:

a fin/tube block including tube ends which are widened and connected flat to each other so as to form a pair of tube end packets, and two collection containers, each of which is installed flush onto a corresponding tube end packet and hermetically brazed to said corresponding tube end packet, at least one partition wall, which can be brazed to at least one of the collection containers while hermetically enclosing the same, provided in the at least one of the collection containers and dividing the collection container, said partition wall having an outer contour corresponding to an inner contour of a wall of the collection container, and a holding leg defined on said partition wall for mounting the partition wall on adjacent wall sections of neighboring tube ends of one of the tube end packets which lie flat against each other.

2. The heat transfer device according to claim 1, wherein the holding leg has at least one single-piece, bridge-like latch which protrudes from the partition wall and forms a receiving slit.

3. The heat transfer device according to claim 2, wherein the holding leg is provided with centering flanges for receiving the adjacent wall sections.

4. The heat transfer device according to claim 1, wherein the partition wall has at least one fixing nose, at a distance from the holding leg, which extends into a corresponding gap in a wall of the at least one collection container when the partition wall is in a mounted condition.

5. The heat transfer device according to claim 4, wherein the fixing nose is provided with at least one deformable corner which protrudes through the gap in the wall of the collection container in the mounted condition and is deformed so that it grips form-fittingly behind an edge of the gap at the outer side of the collection container.

6. The heat transfer device according to claim 1, wherein the at least one of the collection containers has at least one positioning rib running parallel to the partition wall in a mounting area of the partition wall.

7. The heat transfer device according to claim 6, wherein the at least one positioning rib is one of two parallel separate positioning ribs in the collection container, and the partition wall is provided with support edges, which correspond in dimensions to a distance between the two positioning ribs so that the partition wall, with respect to a longitudinal axis of the collection container, is axially securely held between the positioning ribs.

8. A motor vehicle heat transfer device comprising:

a rib and tube block including a plurality of parallel flat tubes interconnected by a plurality of corrugated ribs, collection containers overlying tube ends of said parallel flat tubes, a partition wall secured within one of the collection containers and dividing the one of the collection containers into container portions, a first end of said partition wall having an outer contour corresponding to an inner contour of a wall of said one of the collection chambers, and a holding leg formed at a second end of said partition wall and receiving, together with said partition wall, adjacent wall sections of adjacent tubes of said parallel flat tubes.

9. The device according to claim 8, and further comprising a fixing flange defined at said first end of said partition wall received within a gap defined in said wall of said one of the collection chambers.

10. The device according to claim 9, wherein said fixing flange includes bent edges engaging an outer surface of said one of the collection chambers.

11. The device according to claim 8, wherein said holding leg is defined by a laterally displaced portion of said partition wall forming a stepped bent support latch and producing a receiving slit for receiving said adjacent wall sections.

12. The device according to claim 8, and further comprising parallel ribs defined within said one of the collection chambers between which said partition wall is retained.

13. The device according to claim 12, and further comprising support edges extending approximately perpendicularly to said partition wall to position the partition wall between pairs of said ribs.

14. The device according to claim 8, wherein said partition wall is disposed between a collection container fluid inlet and a collection container fluid outlet.

15. The device according to claim 8, wherein said partition wall includes lateral indentations for positioning the partition wall on one of the tube ends.

16. The device according to claim 10, wherein said holding leg is defined by a laterally displaced portion of said partition wall forming a stepped bent support latch and producing a receiving slit for receiving said adjacent wall sections.

17. The device according to claim 10, and further comprising parallel ribs defined within said one of the collection chambers between which said partition wall is retained.

18. The device according to claim 16, and further comprising support edges extending approximately perpendicularly to said partition wall to position the partition wall between pairs of said ribs.

19. The device according to claim 10, wherein said partition wall includes lateral indentations for positioning the partition wall on one of the tube ends.

* * * * *